US005618610A

United States Patent [19]

Tomita et al.

[11] Patent Number: 5,618,610

[45] Date of Patent: Apr. 8, 1997

[54] NONWOVEN FABRIC WIPER AND METHOD FOR MAKING IT

[75] Inventors: Katsushi Tomita, Kanonji; Masahiko Shikatani, Kawanoe; Hiroo Hayashi, Kagawa-ken; Mitsuhiro Wada, Kawanoe, all of Japan

[73] Assignee: Uni-Charm Corporation, Ehime-ken, Japan

[21] Appl. No.: 521,095

[22] Filed: Aug. 29, 1995

[30] Foreign Application Priority Data

Aug. 29, 1994 [JP] Japan ..... 6-203202

[51] Int. Cl.[6] ..... D04H 1/06; D04H 1/48; D04H 1/72

[52] U.S. Cl. ..... 428/152; 28/104; 428/168; 428/171

[58] Field of Search ..... 28/104; 428/152, 428/168, 171

[56] References Cited

U.S. PATENT DOCUMENTS 3,616,175 10/1971 Jung .
4,426,420 1/1984 Likkyani ..... 28/104
4,704,113 11/1987 Schoots ..... 604/379
5,059,378 10/1991 Petterson et al. ..... 428/152

FOREIGN PATENT DOCUMENTS 0308320 3/1989 European Pat. Off. .
60-11148 3/1985 Japan .
62-125058 6/1987 Japan .

OTHER PUBLICATIONS

Derwent Publications Ltd., London GB; JP-A-07-054 256 (Daiwabo Create Co. Ltd) Feb. 28, 1995.
Derwent Publications Ltd., London; GB; JP-A-63 309 657) (Shinwa KK), Dec. 16, 1988.

*Primary Examiner*—James C. Cannon
*Attorney, Agent, or Firm*—Lowe, Price, LeBlanc & Becker

[57] ABSTRACT

Here is disclosed an improved nonwoven fabric wiper obtained by a method comprising steps of forming a laminate from a web of thermally shrinkable hydrophobic synthetic fibers and a web of hydrophilic fibers put one upon another, jetting high pressure water onto the laminate supported on a supporting roll provided on its peripheral surface with a plurality of fine projections as well as a plurality of drainage apertures, causing the fibers to be entangled or intertwined and rearranged and thereby forming a nonwoven fabric having uneven fiber distribution densities, and heating the nonwoven fabric to crimp the synthetic fibers so that only portions of relatively high fiber density may bulge.

9 Claims, 2 Drawing Sheets

FIG.1
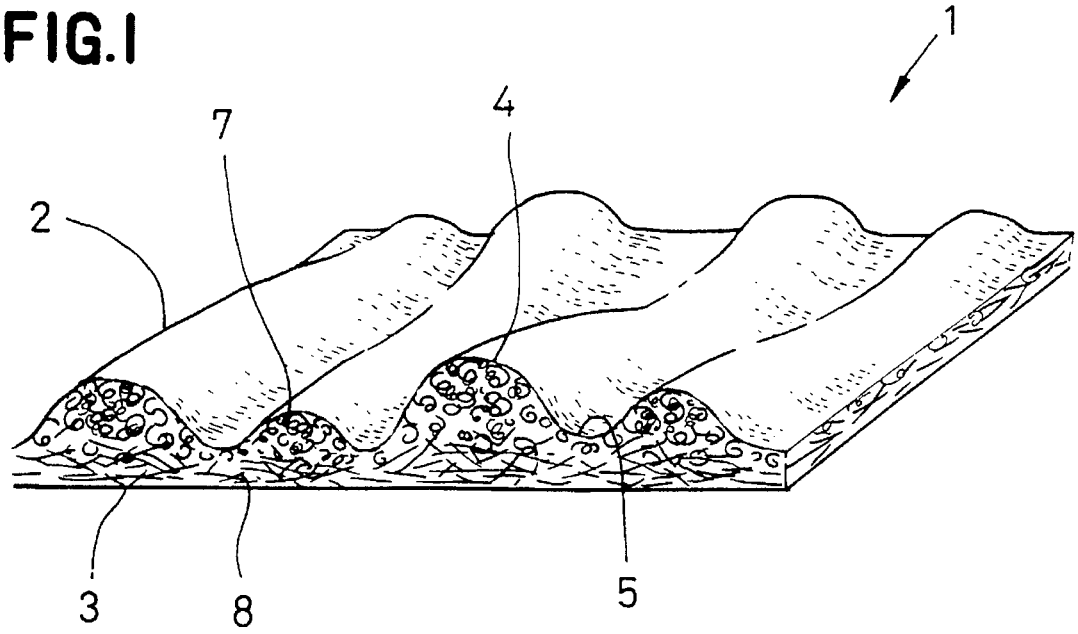
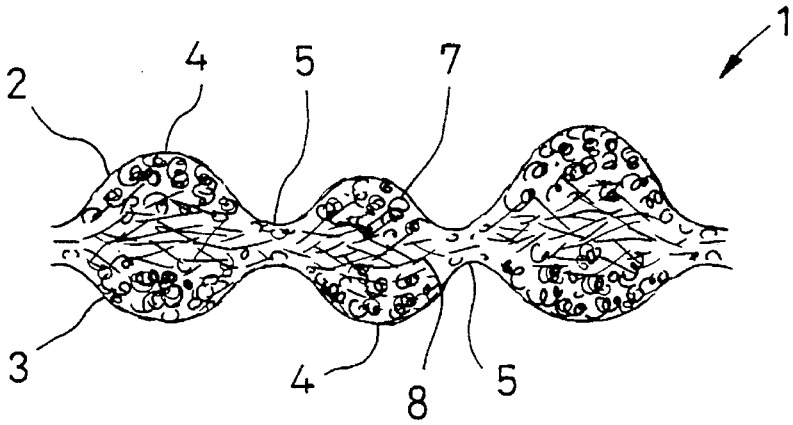
FIG.2
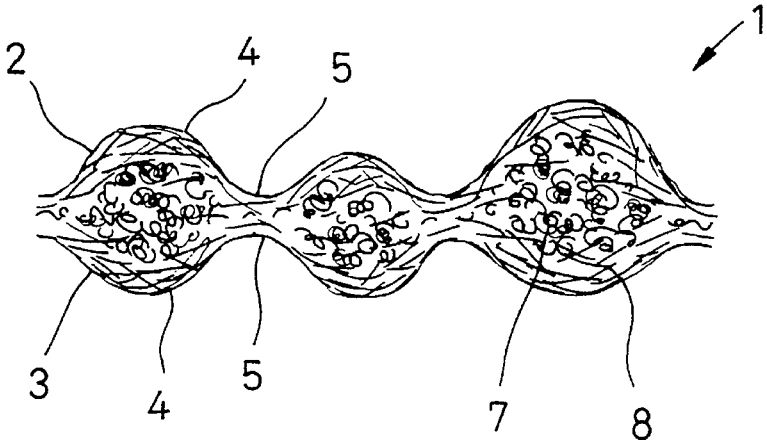
FIG.3

NONWOVEN FABRIC WIPER AND METHOD FOR MAKING IT

BACKGROUND OF THE INVENTION

The present invention relates to a nonwoven fabric wiper used to wipe stains off from an object to be cleaned and a method for making it.

U.S. Pat. No. 3,616,175 discloses a method for a nonwoven fabric for wipers wherein high pressure water is jetted onto a web of rayon fibers placed on a wire mesh from nozzles with fine orifices arranged above the web to entangle the fibers and thereby to obtain the nonwoven fabric wipers. Japanese Patent Application Publication No. 1985-11148, on the other hand, discloses a method for making a nonwoven fabric for wipers wherein a web of thermoplastic polymer filaments is laminated with a mat of thermoplastic polymer microfibers and these components of the laminate are bonded together by intermittently heating them under a pressure to obtain the nonwoven fabric which is excellent in the surface friction characteristic. According to the first-mentioned method, the wire mesh leaves its pattern on the surface of the finished nonwoven fabric which has been in contact with the wire mesh and the high pressure water jets form recesses on the other surface of the finished nonwoven fabric so that the mesh pattern and the recesses form together relatively fine undulations on the respective surfaces. The fibers are mechanically entangled and the nonwoven fabric is generally soft to the touch. In the nonwoven fabric obtained by the second-mentioned method, the spots intermittently heated under a pressure are heat sealed and thinned relative to the remainder so as to form relatively noticeable undulations on the surfaces which well contribute to scrape stains off from an object to be cleaned.

Of the products obtained by the above-mentioned prior art, the nonwoven fabric formed by entangling the fibers under the effect of high pressure water certainly has the undulations on the surfaces, but these undulations are too fine and soft to achieve the desired function of scraping stains off from an object to be cleaned. On the other hand, the nonwoven fabric obtained by partially or intermittently heating the thermoplastic polymer under a pressure is effective to scrape stains off from an object to be cleaned, since the tissue of each heat sealed spot is appropriately rigid and the undulations are relatively noticeable. However, the heat sealed spots lose a fibrous configuration and is solidified, making it difficult to achieve a desired soft touch.

Accordingly, it is a principal object of the invention to overcome the above-mentioned problems of prior art by jetting high pressure water onto a fibrous web containing therein thermally shrinkable fibers to form a nonwoven fabric of uneven fiber distribution density which is then heated to crimp the thermally shrinkable fibers and thereby surface-finishing a wiper with relatively noticeable undulations.

SUMMARY OF THE INVENTION

The object set forth above is achieved, according to the invention, by an improved nonwoven fabric wiper having a plurality of undulations at least on its one surface and being obtained by a method for making it comprising steps of:

a. forming a laminate with at least one layer of hydrophilic fiber web and at least one layer of thermally shrinkable hydrophobic fiber web;

b. jetting high pressure water from nozzles with fine orifices onto the laminate supported on a surface of supporting means provided on its surface with a continuous planar zone, a plurality of intermittently and independently distributed projections and/or recesses and a plurality of fine drainage apertures, causing constituent fibers of said two layers of web to be entangled and rearranged, and thereby forming a nonwoven fabric having uneven fiber distribution densities in the direction (X-Y direction) along the plane defined by the laminate; and c. dewatering and/or drying the nonwoven fabric followed by heat-treating the nonwoven fabric to crimp the synthetic fibers.

To obtain the nonwoven fabric wiper arranged as has been mentioned above, the web laminate is subjected to jet of high pressure water in order to entangle and rearrangement the constituent fibers of the laminate so that the constituent fibers may be accumulated primarily around the respect projections and/or within the respective recesses and thereby the nonwoven fabric having uneven fiber distribution densities in the direction (X-Y direction) along the plane defined by supporting means may be formed. When this nonwoven fabric is heat-treated to crimp the synthetic fibers, the portions of high fiber density more noticeably bulge than the portions of low fiber density, since the formers contain relatively large quantity of synthetic fibers. Thus the undulations initially present on the surface of the nonwoven fabric are made more noticeable.

With such a nonwoven fabric wiper, the crimped synthetic fibers accumulated in the form of projections will lose substantially no rigidity and be not easily collapsed even in their wet condition.

BRIEF DESCRIPTION OF THE DRAWINGS

FIG. 1 is a schematic perspective view showing, in an enlarged scale, a wiper according to the invention;

FIG. 2 is a sectional end view showing a variant of the wiper according to the invention;

FIG. 3 is a view similar to FIG. 2 showing another variant of the wiper according to the invention;

DESCRIPTION OF THE PREFERRED EMBODIMENTS

Figure 4:
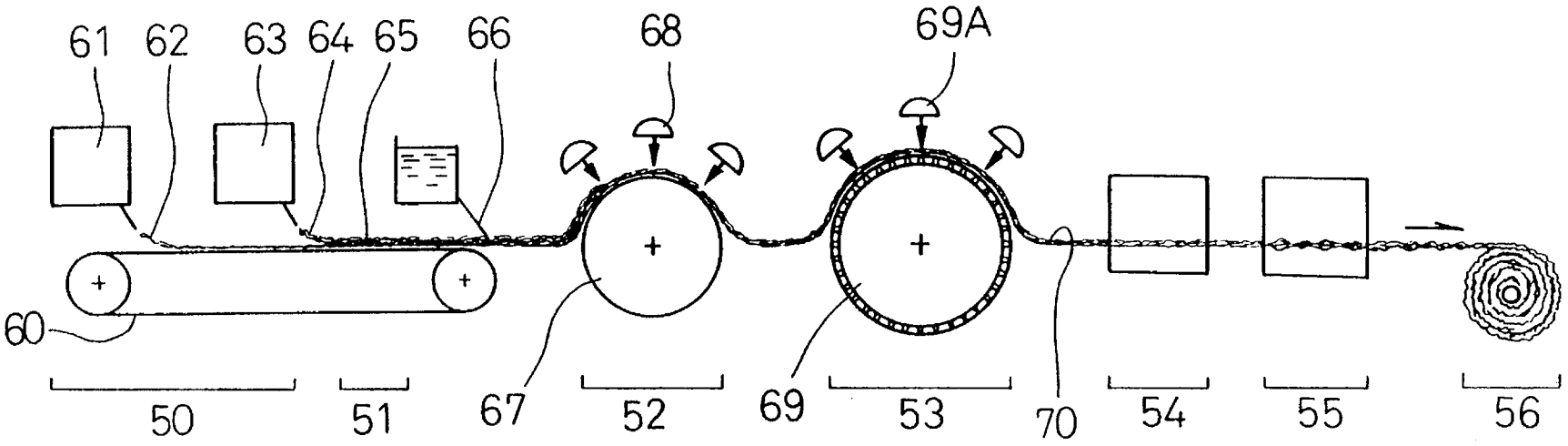
FIG. 4 is a schematic diagram illustrating steps of a method for making the wiper of the invention.

FIG. 1 is a fragmentary perspective view schematically showing a wiper 1 in an enlarged scale. The wiper 1 has a top surface 2 and a bottom surface 3. The top surface 2 has fine undulations consisting of crests 4 of a non-geometric pattern or irregular pattern and troughs 5 of a non-geometric pattern or irregular pattern defined between the respective pairs of adjacent crests 4 and the bottom surface 3 is substantially flat. As a section of the wiper 1 indicates, there are relatively many crimped hydrophobic synthetic fibers 7 in the proximity of the top surface 2 while there are relatively many straight or gently curved hydrophilic rayon fibers 8 in the proximity of the bottom surface 3. The synthetic fibers 7 and the rayon fibers 8 are mechanically entangled or intertwined not only with the fibers of the same types but also with the fibers of the other types and thereby form a nonwoven fabric. Both the fibers 7 and the fibers 8 present their distribution densities (the number of individual fibers per unit area of the nonwoven fabric) which are higher in the crests 4 than in the troughs 5.

The wiper 1 is destined to be used with its top surface 2 put against an object to be cleaned such as a table or a wall after previously immersed with water or suitable chemical fluid. Water or chemical fluid is held by the hydrophilic rayon fibers once and gradually exudes therefrom under a pressure exerted upon the wiper 1 so that any stains may be smoothly wiped off from the object. The crests 4 on the top surface 2 function to scrape the stains off from the object while the troughs 5 function as passages along which the stains having been scraped off are drained together with water or chemical fluid. The crests 4 primarily consist of mechanically entangled or intertwined hydrophobic synthetic fibers 7, therefore, they maintain a desired rigidity and are not readily collapsed even when the wiper 1 is immersed with water or chemical fluid. In this manner, the wiper 1 maintains a high scraping effect as well as a high stain draining effect.

FIGS. 2 and 3 are sectional end views schematically showing alternative embodiments of the wiper 1 in an enlarged scale. According to the variant of the wiper 1 shown by FIG. 2, both the top and bottom surfaces 2, 3 have the crests 4 and the troughs 5 wherein, in the proximities of the top and bottom surfaces 2, 3, the crests 4 are filled with the crimped synthetic fibers 7 and an intermediate zone defined between top and bottom surfaces 2, 3 is filled with the rayon fibers 8. The variants of FIGS. 2 and 3 are similar to the embodiment of FIG. 1 in that both the fibers 7 and the fibers 8 have their distribution densities being higher in the crests 4 than in the troughs 5; the crests 4 primarily consist of the crimped synthetic fibers 7; and the fibers 7, 8 are mechanically entangled or intertwined to form the nonwoven fabric. The wiper 1 of FIG. 3 also has the crests 4 and the troughs 5 on both the top and bottom surfaces 2, 3 as the wiper 1 of FIG. 2 is so, but is different from the wiper 1 of FIG. 2 in that, in the proximities of the top and bottom surfaces 2, 3, the crests 4 are filled with the rayon fibers 8 and the intermediate zone defined between the top and bottom surfaces 2, 3 is filled with the synthetic fibers 7. The wiper 1 is advantageous in that exudation of water or chemical fluid from the top and bottom surfaces 2, 3 is promoted and the wiper 1 does not get out of shape, since the crests 4 contain the crimped synthetic fibers 7 as their cores. While the crests 4 and the troughs 5 on the top surface 2 are shown as accurately opposed to the corresponding crests 4 and troughs 5 on the bottom surface 3 in FIGS. 2 and 3, and function of the wiper 1 is never affected even when such position-relationship is not established.

FIG. 4 is a schematic diagram illustrating steps of a method for making the wiper of the invention. The method comprises a step of web feeding 50, a step of immersion 51, a step of primary high pressure water treatment 52, a step of secondary high pressure water treatment 53, a step of dewatering and drying 54, a step of heat treatment 55 and a step of taking-up 56 in this order.

During the step of web feeding 50, a web 62 of hydrophilic fibers 8 is continuously fed from a first random webber 61 onto an endless belt 60 running rightward as viewed in FIG. 4 and then a web 64 of thermally shrinkable hydrophobic synthetic fibers 7 is continuously fed from a second random webber 63 onto the web 62 to form a web laminate 65 of these two layers of web 62, 64.

During the step of immersion 51, running curtain water 66 is gently supplied from above to the laminate 65 all over its width to immerse the laminate with water and thereby stabilize its texture so that the laminate 65 may smoothly run.

During the step of primary high pressure water treatment 52, the laminate 65 is guided to a first supporting roll 67 provided on its smooth peripheral surface with drainage apertures each having a diameter of 0.2 to 2.0 mm at an area ratio of 5 to 50% and rotating clockwise as viewed in FIG. 4 and high pressure water of 20 to 100 kg/cm$^2$ is jetted from nozzles 68 with fine orifices arranged transversely as well as circumferentially of the roll 67 to the laminate 65 at a rate of 0.5 to 20 liter/m$^2$, causing the fibers 7, 8 of the laminate 65 to be mechanically entangled or intertwined. Within the first supporting roll 67, there is provided suction means (not shown) serving to promote drainage.

During the step of secondary high pressure water treatment 53, the laminate 65 having their fibers entangled or intertwined by the first supporting roll 67 is guided to a second supporting roll 69 provided on its smooth peripheral surface with semispheric projections each having a diameter of 0.3 to 15 mm and a height of 0.4 to 10 mm at a pitch of 1 to 15 mm as well as drainage apertures each having a diameter of 0.2 to 2.0 mm at an area ratio of 2 to 35% and rotating clockwise as viewed in FIG. 4. The laminate 65 is treated ion the same manner as during the previous step 52 but preferably by water jetted from nozzles 69A with fine orifices under a pressure as well as at a water supply rate higher than during the previous step 52 so that the fibers 7, 8 may be moved from summits to bases of the semispheric projections and reoriented. As a result, the fibers 7, 8 become dense around the bases and sparse on the summits of the respective semispheric projections so as to form a nonwoven fabric 70 presenting the uneven distribution densities of fibers in the direction along the plane defined by the second supporting roll 69. The surface of the nonwoven fabric 70 having contacted the peripheral surface of the second supporting roll 69 obtains a pattern partially transferred from the roll 69 and the surface of the nonwoven fabric 70 having been subjected to the high pressure water jets presents recessed streaks formed by such high pressure water jets. In this manner, fine undulations are formed on both surfaces of the nonwoven fabric 70.

Details of the steps 51 through 53 are substantially the same as the corresponding steps described by the applicant of the present application in Japanese Laid-Open Patent Application No. 1987-125058 and therefore any additional description of these steps is not made herein.

During the step of drying 54, the nonwoven fabric 70 wetted by the previous step 53 is subjected to vacuum suction for dewatering and then to hot air for drying.

During the step of heat treatment 55, the nonwoven fabric 70 is heated at a temperature sufficiently high to crimp the thermally shrinkable synthetic fibers 7. Due to such crimp, portions of the nonwoven fabric 70 in which the synthetic fibers 7 are densely distributed form the crests 4 as shown in FIG. 1 while portions in which the fibers 7 are sparsely distributed practically do not bulge and form the troughs 5. In this manner, noticeable undulations which could not be obtained during the previous steps 50 through 54 are formed for the most part on the top surface 2 of the nonwoven fabric 70 because the synthetic fibers 7 are present primarily in the proximity of the top surface 2. Such nonwoven fabric 70 is an original roll of the wiper 1, destined to be taken-up in the subsequent step 56 and thereafter cut into a desired dimension for individual wipers 1.

It is preferred in these steps to use, as the hydrophobic synthetic fibers 7, the well known composite fibers of side-by-side or core/sheath type made from two kinds of synthetic resin having different shrinkage temperatures in a quantity of 20 to 80% by weight of the nonwoven fabric 70 and, as the hydrophilic fibers 8, rayon fibers or natural fibers such as fluff pulp or synthetic fibers treated to be made hydrophilic in a quantity of 80 to 20% by weight of the nonwoven fabric 70. The synthetic fibers 7 and/or the hydrophilic fibers 8 may be mixed with the third fibers of a nature different from them amounting up to 30% by weight. For example, the synthetic fibers 7 may contain therein suitable non-shrinkable synthetic fibers amounting 30% by weight. The wiper 1 generally comprises the synthetic fibers 7 and the hydrophilic fibers 8 combined so as to provide a weight per unit area of 30 to 200 g/m$^2$. Preferably, denier, crimp percentage and weight ratio of each fiber 7, 8 are selected so that the wiper 1 may have a mean coefficient of friction (MIU) in a range from 0.50 to 0.70 and a mean deviation (MMD) for the coefficient of friction in a range from 0.01 to 0.02. MIU is a measure of slip-resistance and MMD is a measure of roughness, both of which are specifically described in "Standardization and analysis of feeling assessment" (Second Edition), published from Japan Textile Machinery Society. It has been found that the wiper 1 having the above-mentioned numerical characteristics is efficient particularly in its function of scaping stains off from an object to be cleaned.

While the wiper 1 has been described as comprising the two-layered laminate 65 consisting of the web 62 and the web 64, it is also possible without departing from the scope of the invention to put an additional layer of web upon any one of said two layers, i.e., to construct the wiper 1 in the form of a three-layered laminate 65. It is also possible for the step of secondary high pressure water treatment 53 to replace the semispheric projections on the peripheral surface of the second supporting roll 69 by fine recesses. In this case, the constituent fibers of the laminate 65 are moved toward and densely accumulated in those recesses under the effect of the high pressure water jetted thereon. Correspondingly the constituent fibers become sparse on the smooth zone of the roll 69.

The wiper according to the invention is soft to the tough, since it is made of the nonwoven fabric having the constituent fibers mechanically entangled or intertwined. The surface of the wiper has relatively noticeable undulations and the crests thereof contribute to improve an efficiency to scrape stains off from an object to be cleaned. These crests primarily comprise the crimped synthetic fibers and maintain their rigidity even when the fibers are in wet condition. Therefore, the wiper is not readily collapsed.

The undulations on the surface of the wiper can be formed more noticeably and easily than they can be formed during the step of making the nonwoven fabric, since the wiper of the invention has its surface undulated by unevenly distributing and crimping the thermally shrinkable hydrophobic synthetic fibers.

What is claimed is:

1. A nonwoven fabric wiper having a plurality of undulations at least on its one surface and being obtained by a method for making it comprising steps of:

a. forming a laminate with at least one layer of hydrophilic fiber web and at least one layer of thermally shrinkable hydrophobic fiber web;

b. jetting high pressure water from nozzles with fine orifices onto said laminate supported on a surface of supporting means provided on its surface with a continuous planar zone, a plurality of intermittently and independently distributed projections and/or recesses and a plurality of fine drainage apertures, causing constituent fibers of said two layers of web to be entangled and rearranged, and thereby forming a nonwoven a fabric having uneven fiber distribution densities in the direction of the plane defined by said laminate; and c. dewatering and/or drying said nonwoven fabric followed by heat-treating said nonwoven fabric to crimp said synthetic fibers.

2. A nonwoven fabric wiper according to claim 1, wherein said wiper has a top surface and a bottom surface, said top surface has fine undulations consisting of crests of a non-geometric pattern and troughs of a non-geometric pattern defined between the respective pairs of adjacent crests, and said bottom surface is substantially flate.

3. A nonwoven fabric wiper according to claim 2, wherein there are relatively many crimped hydrophobic synthetic fibers in the proximity of said top surface while there are relatively many straight or gently curved hydrophilic fibers in the proximity of said bottom surface.

4. A nonwoven fabric wiper according to claim 1, wherein a top surface and a bottom surface, said top and bottom surfaces have fine undulations consisting of irregular crests and irregular troughs defined between the respective pairs of adjacent crests.

5. A nonwoven fabric wiper according to claim 4, wherein, in the proximities of said top and bottom surfaces said crests are filled with the crimped hydrophobic synthetic fibers and an intermediate zone defined between said top and bottom surfaces is filled with the hydrophilic fibers.

6. A nonwoven fabric wiper according to claim 4, wherein, in the proximities of said top and bottom surfaces, said crests are filled with the hydrophilic fibers and an intermediate zone between said top and bottom surfaces is filled with said hydrophobic synthetic fibers.

7. A nonwoven fabric wiper according to claim 1 wherein said hydrophobic synthetic fibers and said hydrophilic fibers have their distribution densities being higher in said crests than in said troughs.

8. A method for making a nonwoven fabric wiper according to claim 1, wherein said supporting means comprises a roll and said roll provided on its smooth peripheral surface with semispheric projections each having a diameter of 0.3 to 15 mm and a height of 0.4 to 10 mm at a pitch of 1 to 15 mm as well as said drainage apertures each having a diameter of 0.2 to 2.0 mm at an area ratio of 2 to 35%.

9. A method for making a nonwoven fabric wiper according to claim 1, wherein said high pressure water of 20~100 kg/cm$^2$ is jetted from said orifices arranged transversely as well as circumferentially of said supporting means to said laminate at a rate of 0.5 to 20 liter/m$^2$.

* * * * *